US005125865A

United States Patent [19]

Orenstein et al.

[11] Patent Number: 5,125,865

[45] Date of Patent: Jun. 30, 1992

[54] TOY DOLL CONSTRUCTION

[75] Inventor: Henry Orenstein, Verona, N.J.; Joseph Wetherell, New York, N.Y.; Alan Buckwalter, Philadelphia, Pa.

[73] Assignee: Toy Builders, West Caldwell, N.J.

[21] Appl. No.: 591,713

[22] Filed: Oct. 2, 1990

[51] Int. Cl.[5] ..... A63H 3/00; A63H 13/00

[52] U.S. Cl. ..... 446/304; 446/320; 446/353

[58] Field of Search ..... 446/304, 305, 306, 320, 446/337-341, 353

[56] References Cited

U.S. PATENT DOCUMENTS

| | | | |
|---|---|---|---|
| 268,020 | 11/1882 | Howard | 446/320 |
| 2,154,121 | 4/1939 | Bold | 446/320 X |
| 2,564,813 | 8/1951 | Moyers, Sr. | 446/320 |
| 2,586,081 | 2/1952 | Philippi | 446/304 |
| 2,623,329 | 12/1952 | DiLeva | 446/320 |
| 2,669,063 | 2/1954 | Lang | 446/320 |
| 2,741,870 | 4/1956 | Lang | 446/320 |
| 2,767,516 | 10/1956 | Del Mas | 446/320 |
| 3,230,664 | 11/1966 | Bornn et al. | 446/306 X |
| 3,383,795 | 5/1968 | Ryan et al. | 446/304 |
| 3,828,467 | 8/1974 | Kaelin | 446/320 |
| 3,918,199 | 11/1975 | De Masi | 446/305 X |
| 3,992,807 | 11/1976 | Sapkus et al. | 446/320 |
| 3,995,394 | 12/1976 | Ayton | 446/320 |
| 4,246,722 | 1/1981 | Sapkus et al. | 446/320 |
| 4,259,807 | 4/1981 | Silverstein | 446/320 |
| 4,276,714 | 7/1981 | Albert et al. | 446/304 X |
| 4,622,021 | 11/1986 | Darrigo, Sr. | 446/320 |
| 4,828,528 | 5/1989 | Chatkis | 446/320 |

*Primary Examiner*—Mickey Yu
*Attorney, Agent, or Firm*—Brumbaugh, Graves, Donohue & Raymond

[57] ABSTRACT

A toy doll includes a doll body and an animating mechanism in the doll body. The doll body includes a head portion including a resiliently flexible mouth section, a longitudinally expandable and contractible torso portion, and right and left arms and legs. The animating mechanism is operative by manually depressing the mouth section to actuate the animating mechanism to reciprocally move the mouth section inwardly and outwardly to simulate a chewing activity, and it is thereafter operative by manipulating one of the arms to actuate the animating mechanism to longitudinally expand the torso portion to simulate a growing activity.

11 Claims, 5 Drawing Sheets

TOY DOLL CONSTRUCTION

BACKGROUND AND SUMMARY OF THE INVENTION

The instant invention relates to toy dolls, and more particularly to an animated toy doll which is actuatable for performing a simulated chewing action and for thereafter performing a simulated growing action.

Toy dolls which are operative for performing various simulated human activities have generally been found to have relatively high levels of play value. For example, the toy doll disclosed in the U.S. Pat. to Ornstein et al No. 4,801,286, which is adapted to perform a simulated hair growing activity, has been found to be highly effective and popular with young children. A variety of other toy dolls which are adapted to perform simulated human activities, including body growth, are disclosed in the U.S. Pat. to Howard No. 268,020; Bold No. 2,154.121; Moyers, Sr. No. 2,564,813; DiLeva No. 2,623,329; Lang No. 2,669,063; Del Mas No. 2,767,516; Kaelin No. 3,828,467; Sapkus et al No. 3,992,807; Ayton No. 3,995,394; Silverstein No. 4,259,807; Sapkus et al No. 4,246,722; Darrigo, Sr. No. 4,622,021; and Chatkis No. 4,828,528. Other toy dolls which are adapted for performing various simulated human activities, including facial movements and which, in combination with the patents hereinabove set forth, represent the closest prior art to the subject invention of which the applicant is aware, are disclosed in the U.S. Pat. to Ryan et al No. 3,383,795; and Philippi No. 2,586,081. However, since these references fail to teach a toy doll which is capable of performing a simulated chewing action, or a simulated chewing action in combination with a simulation growing action in the manner of the toy doll in the instant invention, they are believed to be of only general interest with respect thereto.

The instant invention represents a significant advancement in the toy art by providing a toy doll which is capable of performing a simulated chewing activity, and a simulated growing activity following the simulated eating or chewing activity. Specifically, the toy doll of the instant invention includes a doll body comprising a torso portion and a head portion on the torso portion. The torso portion is adapted so that it is longitudinally expandable and contractible for increasing and decreasing the height of the doll body, respectively, and the head portion includes a mouth section which is adapted to permit movement simulating a chewing activity. The doll further includes an animating mechanism in the torso portion which is operative for first moving the mouth section to simulate a chewing activity and for thereafter longitudinally expanding the torso portion to simulate a growing activity. The doll preferably further includes right and left arms, and the animating mechanism is preferably operative by winding the left arm of the doll in a counter clockwise direction while the right arm of the doll is in a downwardly extending position. The animating mechanism is preferably thereafter actuatable by moving the right arm to a forwardly extending position and then depressing the mouth section to actuate the animating mechanism for moving the mouth section to simulate a chewing activity. After the mouth section has been operated for a predetermined period of time to simulate a chewing activity, the animating mechanism is further operative by moving the right arm of the doll to an upwardly extending position to actuate the animating mechanism for performing a simulated growing activity. The torso portion preferably includes slidably interfitting upper and lower torso sections which are movable in telescoping relation for expanding and contracting the torso portion, and the animating mechanism preferably includes a rack-and-pinion gear assembly for expanding and contracting the torso portion. The mouth section of the head portion is preferably made from a resiliently flexible material and the animating mechanism is preferably operable for alternately moving the flexible mouth section inwardly and outwardly to simulate the chewing activity. The animating mechanism preferably includes a gear assembly in the torso portion and a linkage extending from the gear assembly to the mouth section of the head portion. The gear assembly is preferably operative for reciprocating the linkage to move the mouth section inwardly and outwardly to simulate a chewing activity. Further, the animating mechanism is preferably actuatable by manually depressing the mouth section to longitudinally reposition the linkage in order to actuate the gear mechanism for reciprocating the linkage to move the mouth section. Still further, the animating mechanism preferably includes a pivot member in the head portion which is attached to the mouth section, and the linkage is preferably attached to the pivot member for pivoting the pivot member to move the mouth section inwardly and outwardly to simulate a chewing activity. It has been found that the toy doll of the instant invention has a high level of play value as a result of the unique movements of which it is capable. Specifically, it has been found that the toy doll of the instant invention can effectively capture the attention of a child as a result of the human-like movements of which it is capable. Still more specifically, it has been found that the toy doll for the instant invention is effectively capable of performing an amusing simulated chewing activity and for thereafter performing a simulated growing activity, and that these features enable the toy doll of the subject invention to be effectively utilized in a variety of amusing and interesting play themes to provide many hours of amusement.

Accordingly, it is a primary object of this invention to provide an effective and amusing toy doll which is actuatable for performing a plurality of simulated human activities.

Another object of the instant invention is to provide a toy doll which is initially actuatable for performing a simulated chewing activity and which is thereafter actuatable for performing a simulated growing activity.

Another object of the instant invention is to provide a toy doll which is actuatable for performing a simulated chewing action by depressing a mouth section of the doll.

An even still further object of the instant invention is to provide a toy doll including a doll body having an animating mechanism therein, wherein the animating mechanism is initially actuatable for flexing a mouth section of the doll to perform a simulated chewing activity, and which is thereafter actuatable for expanding the torso portion of the doll to perform a simulated growing activity.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
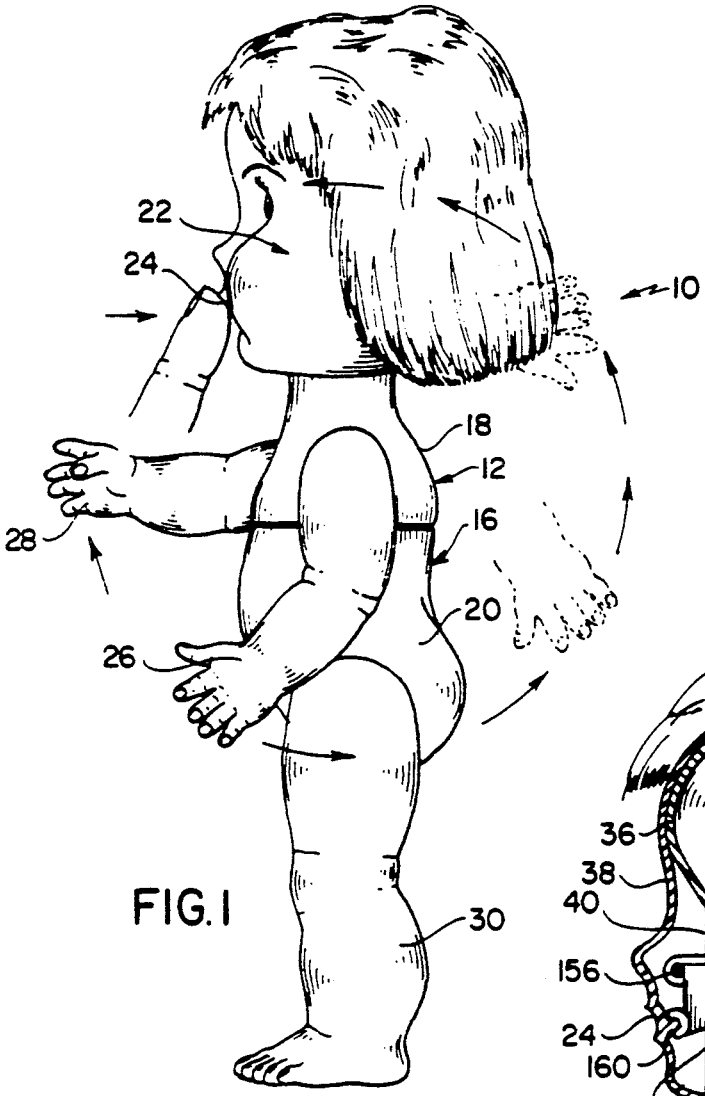
FIG. 1 is a side elevational view illustrating the actuation of the toy doll of the instant invention to perform a simulated chewing activity.
Figure 2:
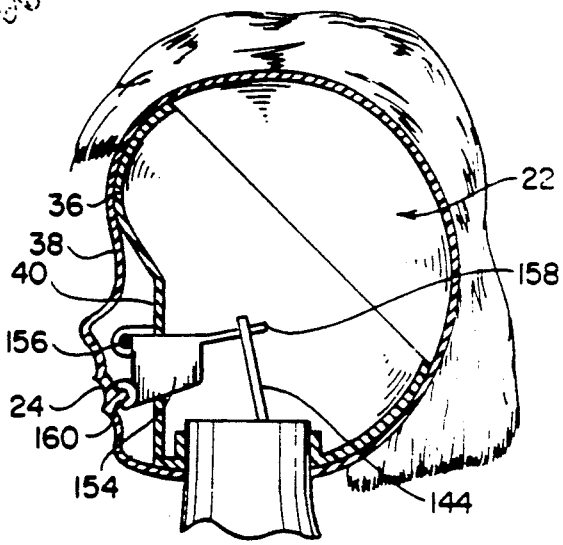
FIGS. 2 and 3 are side sectional views of the head portion of the doll.
Figure 3:
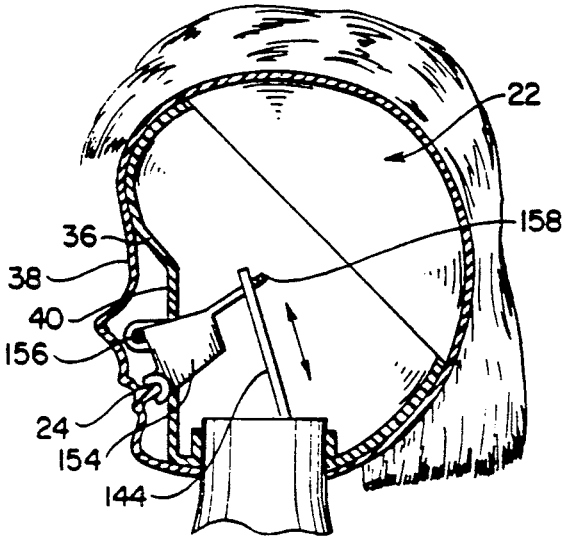
Figure 4:
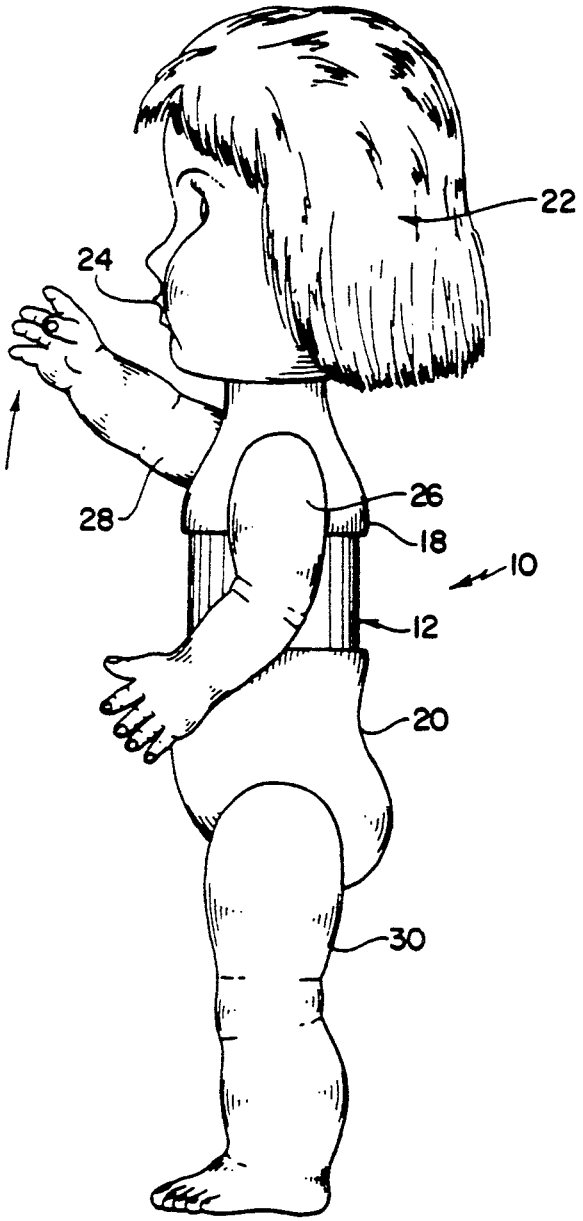
FIG. 4 is a side elevational view illustrating the actuation of the doll to perform a simulated growing activity.
Figure 5:
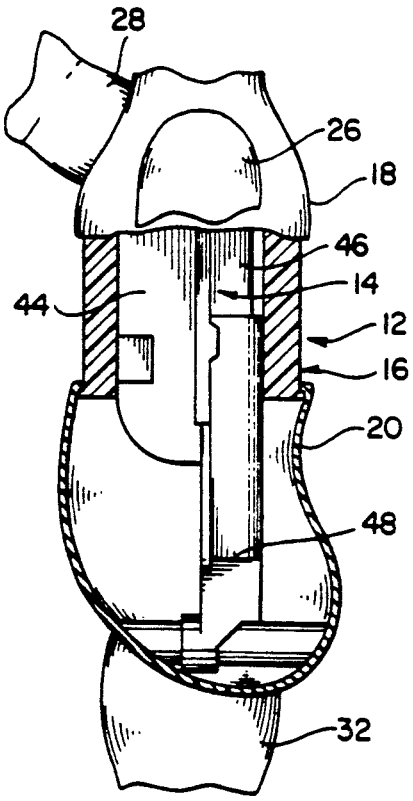
FIG. 5 is a side sectional view of the doll.
Figure 6:
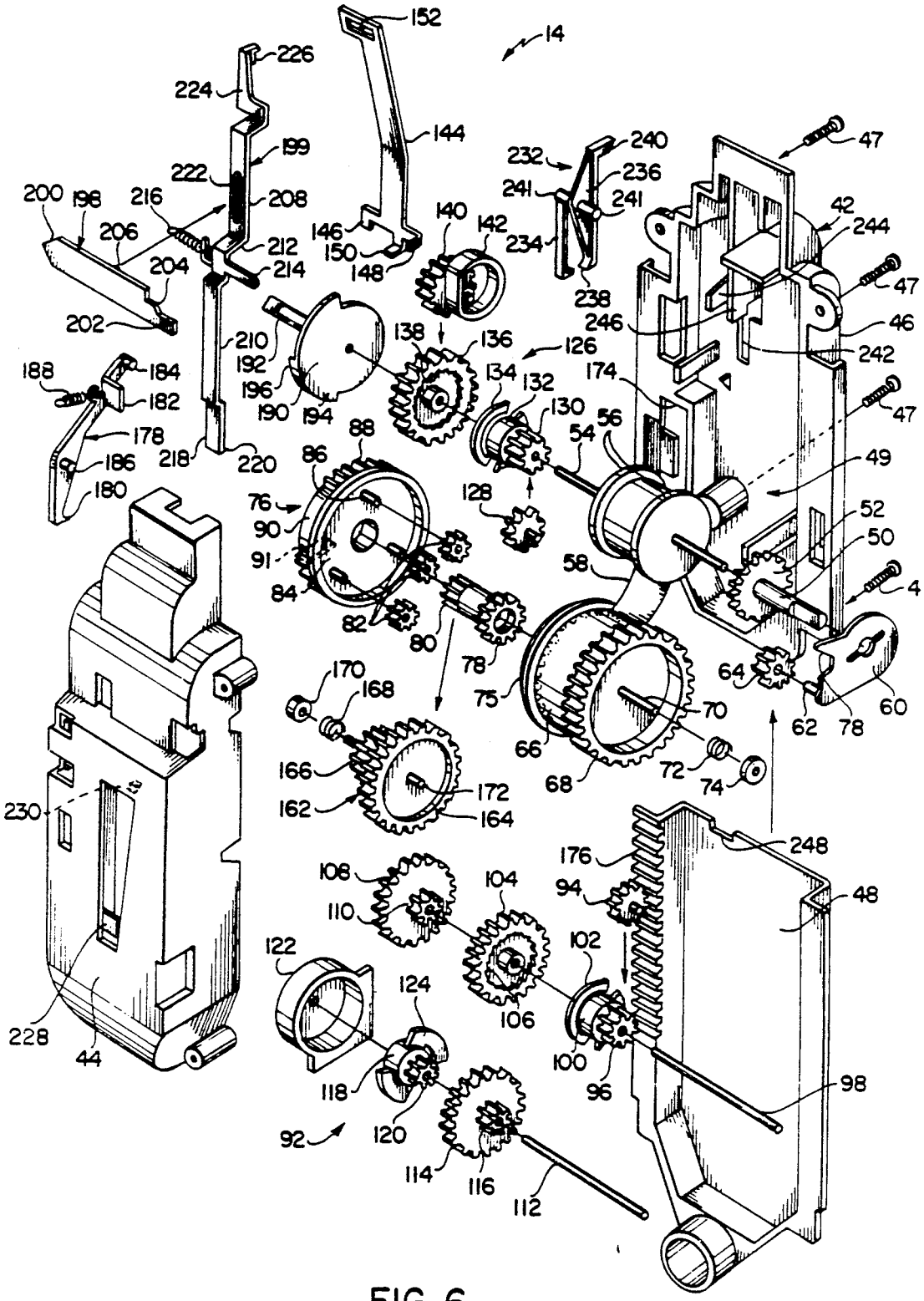
FIG. 6 is an exploded perspective view of the animating mechanism thereof.

Referring now to the drawings, the toy doll of the instant invention is illustrated in FIGS. 1 through 9, and generally indicated at 10 in FIGS. 1, 4, 7 and 8. The toy doll lo includes a doll body generally indicated at 12, and an animating mechanism generally indicated at 14. The doll body 12 comprises a torso portion generally indicated at 16 comprising upper and lower torso portions 18 and 20, respectively, and a head portion generally indicated at 22 including a mouth section 24. The doll body 12 further comprises left and right arms 26 and 28, respectively, and left and right legs 30 and 32, respectively, which are attached to the torso portion 16 in normal human-like orientations. The doll 10 is operative by positioning the right arm 28 in a downwardly extending position and rotating the left arm 26 in a counter clockwise direction in order to wind the animating mechanism 14. The doll 10 is thereafter actuatable for performing a simulated chewing activity by positioning the right arm 28 in a forwardly extending position as illustrated in FIG. 1, and then manually depressing the mouth section 24. Once the animating mechanism 14 has been actuated in this manner the mouth section 24 is reciprocated inwardly and outwardly by the animating mechanism 14 for a predetermined period of time in order to cause the mouth section 24 to perform a simulated chewing activity. Thereafter, the animating mechanism 14 is further actuatable to cause the doll 10 to perform a simulated growing activity wherein the torso portion 16 is moved to an expanded or elongated disposition by moving the right arm 28 to an upwardly extending position as illustrated in FIG. 4.

The doll body 12 comprises the torso portion 16, which includes the upper and lower torso sections 18 and 20, respectively. The upper and lower torso sections 18 and 20 are preferably made of a suitable, substantially rigid plastic material and the upper torso section 18 preferably includes a reduced downwardly extending tubular section 34 which is slidably received in telescoping relation in the lower torso section 20, as illustrated in FIGS. 4, 5, 7 and 8. The left and right arms 26 and 28, respectively, are rotatably attached to the upper torso section 18, and the left and right legs 30 and 32, respectively, are rotatably attached to the lower torso section 20. The arms 26 and 28, and the legs 30 and 32, are preferably made from a suitable plastic material which has a slight degree of resilient flexibility in order to impart human-like characteristics to the arms 26 and 28, and the legs 30 and 32.

The head portion 22 is illustrated most clearly in FIGS. 2 and 3, and it includes a rigid inner support structure 36 and a resiliently flexible outer shell 38. The outer shell 38 is formed in the configuration of a human head and it is received and supported on the support structure 36. The support structure 36 is generally formed in the configuration of a human skull. However, the support structure 36 is constructed so that it includes a front portion 40 which is spaced rearwardly from the front facial portion of the outer shell 38, as illustrated. As a result, the front facial portion of the doll's head 22, including the mouth section 24, is resiliently deflectable in a rearward direction for actuating the animating mechanism 14 and for thereafter enabling the doll 10 to perform a simulated chewing activity.

Referring now to FIGS. 5 through 9, the animating mechanism 14 is illustrated. The animating mechanism 14 comprises a housing generally indicated at 42 including front and rear housing sections 44 and 46, respectively, which are secured in assembled relation with screws 47, a rack assembly 48 which is received on the outer side of the rear housing section 46, and a plurality of gears and actuating members which are contained within the housing 42.

Specifically, the animating mechanism 14 comprises a winding assembly generally indicated at 49 which comprises a left arm shaft 50 on which the left arm 26 is received, and a main winding gear 52 which is integrally formed with the shaft 50. The main winding gear 52 and the arm shaft 50 are rotatably received on a shaft 54 which is rotatably received and secured in the housing 42. Also included in the winding assembly 49 and received on the shaft 54 is a pair of half spool elements 56, and a resilient band spring 58 is received on the half spool elements 56 so that the half spool elements 56 cooperate to define a spool for the spring 58. The band spring 58 is normally biased to a position wherein it is wound in a relatively tight coil on the half spool elements 56, although it is unwindable therefrom to provide a drive spring for the animating mechanism 14. Also included in the winding assembly 49 and received on the shaft 50 is a gear plate 60, having a lug 62 thereon, and a pinion gear 64 is received on the lug 62. The winding assembly 49 still further comprises a winding drum 66 which is assembled with a ring gear 68. A shaft 70 passes through the ring gear 68 and the drum 66, and a conventional internal clutch mechanism (not shown) is provided in the interior of the assembly comprising the ring gear 68 and the drum 66 to provide a slip-clutch action which prevents damage to the spring 58 in the event of overwinding the mechanism 14. A spring 72 and a retainer washer 74 cooperate for biasing the internal clutch mechanism in the drum 66 to prevent slippage between the drum 66 and the ring gear 68 under normal conditions. Provided in the drum 66 at the opposite end thereof from the ring gear 68 is a gear ring 75 having inwardly facing gear teeth thereon. The gear plate 60 has a notch 78 formed therein adjacent the lug 62, and the lug 62 is positioned so that the pinion gear 64 engages the winding gear 52, and so that the pinion gear 64 is engageable with the ring gear 68 under normal conditions, although the gear plate 60 is formed so that it is pivotable slightly in a direction away from the ring gear 68 in order to disengage the pinion gear 64 from the ring gear 68. However, under normal conditions rotation of the shaft 50, such as caused by rotation of the left arm 26 in a counter clockwise direction, causes the ring gear 68 to be rotated so that the band spring 58 is wound onto the drum 66.

Further included in the animating mechanism 14 is a transmission gear assembly 76. The transmission gear assembly 76 comprises an internal transmission gear 78, a reduced external transmission gear 80, a plurality of planetary gears 82, and a hub 84 having a plurality of lugs 86 thereon. Provided on the circumferential surface of the hub 84 is a gear segment 88 which extends over approximately three quarters of the circumference of the hub 84. The circumferential surface of the hub 84 also includes a smooth, or non-toothed, section 90 which extends over approximately one quarter of the circumference of the hub 84. The internal and external transmission gears 78 and 80, respectively, are integrally formed and received on the shaft 70, and the planetary gears 82 are received on the lugs 86. Further, the hub 84 is assembled with the drum 66 so that the planetary gears 82 engage the internal gear teeth in the gear ring 76 and so that the planetary gears 82 also engage the internal transmission gear 78. Accordingly, the hub 84 can be rotated by retaining the exterior transmission gear 80 in a stationary position as the drum 66 is rotated, and the external transmission gear 80 can be rotated by retaining the drum 84 in a stationary position as the drum 66 is rotated.

Also included in the animating mechanism 14 is a governor assembly generally indiated at 92 which is operative for retarding the operation of the animating mechanism 14. The governor assembly 92 comprises a primary governor driver gear 94, which is rotatably received in a pair of notched tabs (not shown) in the housing section 44 so that it engages the ring gear 68. The governor assembly 92 further comprises a secondary governor drive gear 96 which is received on a shaft 98. The shaft 98 is also rotatably mounted in a pair of notched tabs (not shown) in the housing section 44, and a ratchet member 100 having a pair of arcuate ratchet arms 102 thereon is integrally formed with the secondary drive gear 96 and received on the shaft 98. A ratchet ring gear 104, having an internal ratchet ring 106 formed therein, is also received on the shaft 98 and the ratchet member 100 is received in the gear 104 so that the ratchet arms 102 engage the ratchet ring 106 to communicate rotation in a direction corresponding to unwinding the band 58 from the drum 66 during unwinding of the animating mechanism 14, but not in a direction corresponding to winding of the band 58 on the drum 66. A first enlarged intermediate gear 108, having a first reduced intermediate gear 110 integrally formed therewith, is also received on the shaft 98. Also included in the governor assembly 92 is a shaft 112 having a second enlarged intermediate gear 114 thereon which is integrally formed with a second reduced intermediate gear 116. Further included in the governor assembly 92 is a governor member 118 which is attached to a governor member pinion gear 120 and a governor housing 122. The governor member 118, the pinion gear 120 and the housing 122 are all rotatably received on the shaft 112, and the governor member 118 is received within the governor housing 122. The governor housing 122 has a circular cavity formed therein for receiving the governor member 118 although the exterior of the governor housing 122 is formed so that it engages the housing section 44 to prevent the governor housing from rotating with the governor member. The governor member 118 is preferably formed from an elastomeric material, such as a silicone rubber, and it includes a pair of leaves 142 which are outwardly deflectable as a result of the centrifugal forces which are developed as the governor member 118 is rotated at a high rate of rotation. Accordingly, when the governor member 118 is rotated in the housing 122, the leaves 124 engage the interior surfaces of the housing 122 to frictionally retard the rotation of the governor member 118 and the gear 120. During operation of the governor assembly 92, the primary governor drive gear 94 engages the secondary governor drive gear 96 to communicate rotation to the ratchet member 100. The ratchet arms 102 then communicate rotation to the ratchet ring gear 104 as long as the ratchet member 100 is rotated in a direction which corresponds to unwinding the band spring 58 from the drum 66. The ratchet ring gear 104 intermeshes with the second reduced intermediate gear 116 to communicate rotation to the second enlarged intermediate gear 114, and the second enlarged intermediate gear 114 intermeshes with the first reduced intermediate gear 110 to effect rotation of the first enlarged intermediate gear 108. The first enlarged intermediate gear 108 engages the pinion gear 120 on the governor member 118. As will be seen, the net effect of communicating rotation to the governor member 118 through the gears 104, 116, 114, 110, 108, and 120 is to cause the governor member 118 to rotate at a significantly increased rate of rotation as compared to the primary governor drive gear 94 so that the governor leaves 124 are urged outwardly by centrifugal forces so that they frictionally engage the inner surface of the housing 122 to retard the rotation of the governor member 118.

The animating mechanism 14 further comprises a mouth animating assembly generally indicated at 126. The mouth animating assembly 126 includes a primary drive gear 128, which intermeshes with a secondary drive gear 130. The primary drive gear 128 is received in a pair of notched tabs (not shown) in the front housing section 44 so that it can intermesh with the gear segment 88 on the hub 84, and the secondary drive gear 130 is integrally formed with a ratchet member 132 on the shaft 54. The ratchet member 132 includes a pair of arcuate ratchet arms 134 and the mouth animating assembly 126 further includes an enlarged gear 136 having a ratchet ring 138 therein. The ratchet arms 134 are received in the enlarged gear 136 so that the ratchet arms 134 engage the ratchet ring 138 to communicate rotation to the enlarged gear 136 in one direction only, which direction corresponds to unwinding of the band spring 58 from the drum 66. This prevents the animating mechanism 14 from operating to move the mouth section 24 as the animating mechanism is rewound. The enlarged gear 136 is also assembled on the shaft 54, and it intermeshes with a pinion gear 140 which is mounted in a pair of notched tabs (not shown) in the front housing section 44. Attached to the pinion gear 140 is an eccentric ring 142 which is eccentrically orientated relative to the axis of the pinion gear 140. Accordingly, when the drive gear 128 is aligned with the gear segment 88 on the hub 84 rather than with the smooth section 90, rotation of the hub 84 in a clockwise direction causes the gears 128, 130, 136 and 140 to be rotated, whereas rotation of the hub 84 in a counterclockwise direction causes only the gears 128 and 130 to be rotated, so that the gears 136 and 140 remain stationary. Further included in the mouth animating mechanism 126 is a linkage member 144 having a cam leg 146, a guide leg 148, and a tab 150 thereon. The guide leg 148 is received in an integrally molded track (not shown) in the first housing section 44 for guiding the linkage member 144 so that it is longitudinally slidable in the housing 42. The cam leg 146 is positioned so that it rides on the outer surface of the eccentric ring 142, and accordingly, the linkage member 144 is longitudinally repositioned as the eccentric ring 142 is rotated in the housing 42. Formed on the opposite end of the linkage member 144 from the tab 150, the cam leg 146 and the guide leg 148 is a rectangular aperture 152. Further, as illustrated in FIGS. 2 and 3, a pivot member 154 is assembled and secured in the head portion 22 so that it is pivotable about an axis 156. The pivot member includes a rearwardly extending leg 158 which is received in the aperture 152, and a forwardly extending mouth portion 160 which is attached to the mouth portion 24 of the flexible shell 38. Accordingly, as the linkage member 144 is longitudinally reciprocated by the eccentric ring 142, the pivot member 154 is pivoted to alternately deflect the mouth portion 24 outwardly or inwardly to simulate a chewing action.

Figure 7:
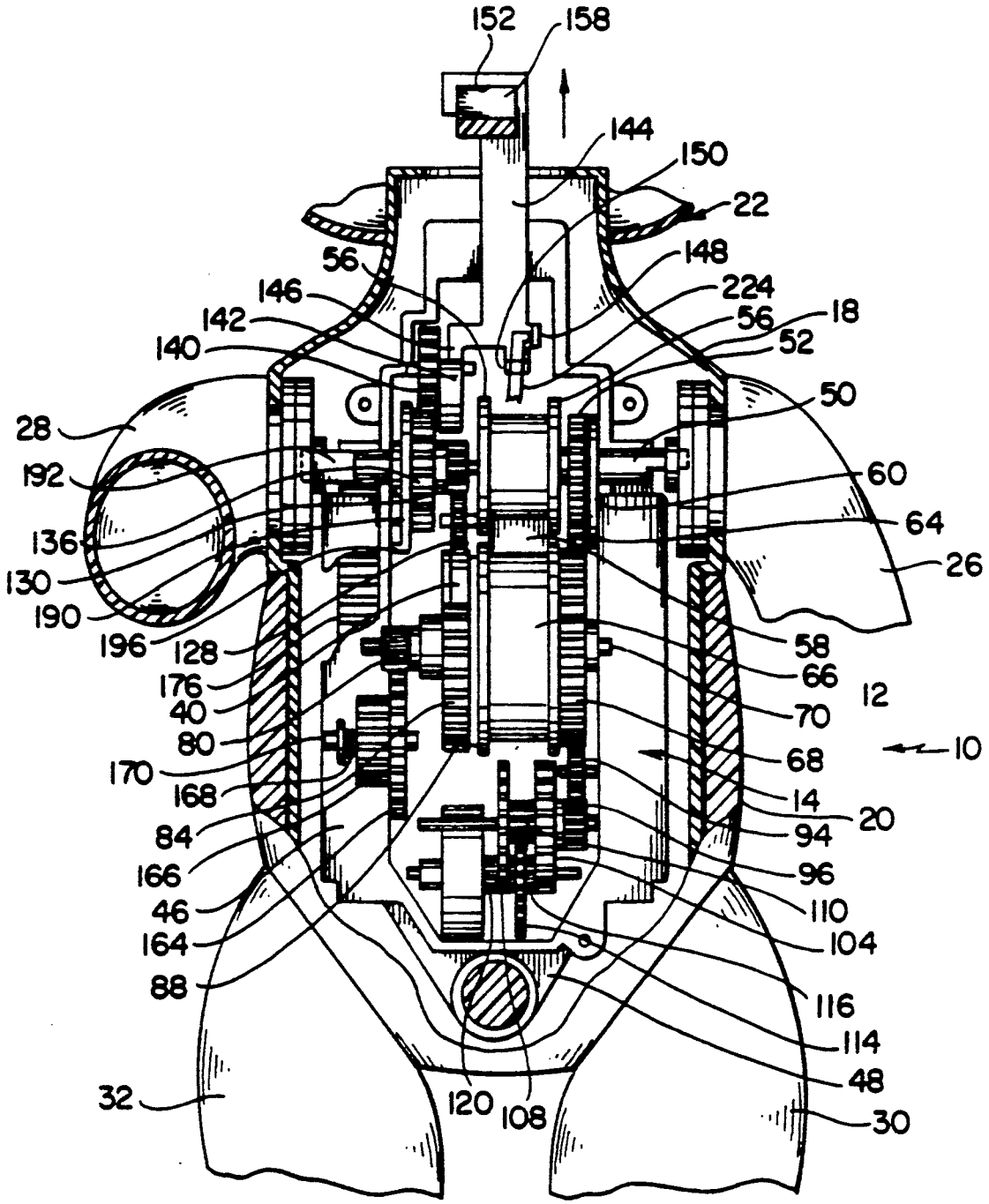
FIG. 7 is a front sectional view of the doll illustrating the animating mechanism.
Figure 8:
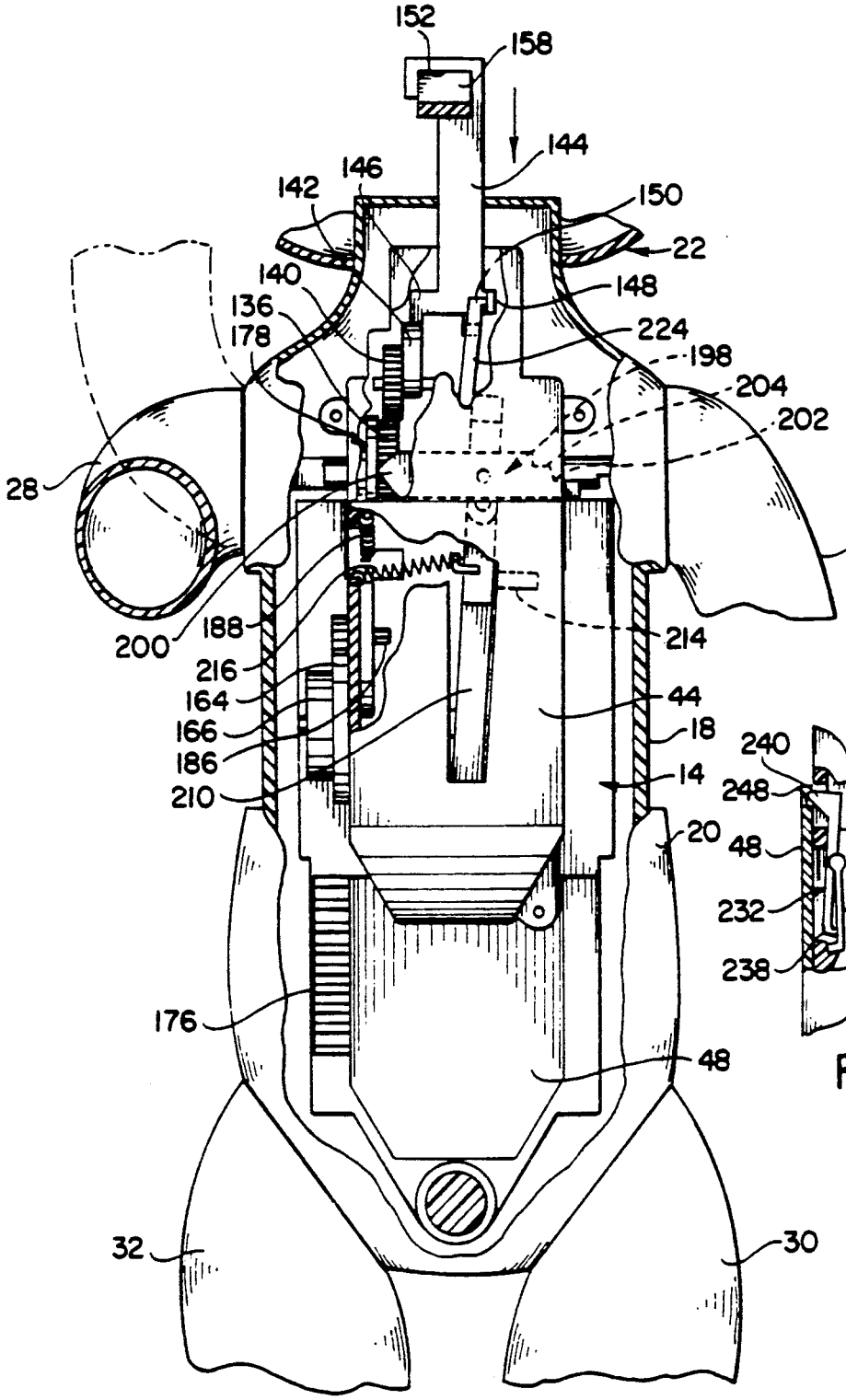
FIG. 8 is another front sectional view of the doll.
Figure 9:
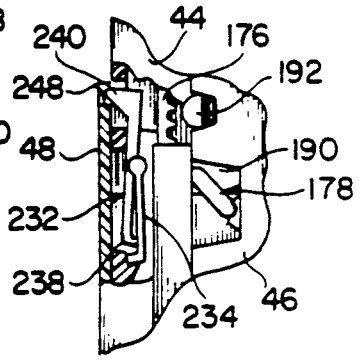
FIG. 9 is a fragmentary side sectional view of the rear latching assembly of the animating mechanism.

The animating mechanism 14 further comprises a drive gear assembly 162, including an intermediate gear 164 and a main drive gear 166, and a spring 168 and a retainer washer 170, are received and coaxially mounted with the gears 164 and 166 on a common shaft 172. The shaft 172 is received in a pair of notched tabs (not shown) in the front housing section 44 so that the intermediate gear 164 intermeshes with the external transmission gear 80 of the transmission gear assembly 76. When the gears 164 and 166 are assembled in the housing section 44 in this manner, the main drive gear 166 projects through an opening 174 in the rear housing section 46. The rack gear assembly 48 is assembled on the exterior of the rear housing section 46, and it includes a gear segment 176 which intermeshes with the main drive gear 166 for slidably repositioning the rack assembly 48 relative to the housing 42. In this connection, the housing section 46 includes tabs (not shown) on the rear side thereof, which overlap the side edge portions of the rack assembly 48 to retain it in slidable relation on the rear side of the housing section 46 and the lower end of the rack assembly 48 is attached to the lower torso section 20 as illustrated in FIGS. 7 and 8.

The animating mechanism 14 further includes a plurality of latch and linking members which are operative for controlling the different gear assemblies hereinabove set forth. Specifically, the animating mechanism 14 includes a latch member 178 having a latch tooth 180 thereon, a tab 182 and a terminal lug 184. The latch member 178 further includes a post 186 which is rotatably received and secured in the front housing section 44 by means of an integrally formed notched tab (not shown) in the front housing section 44. The latch member 178 is biased by means of a spring 188 to a position wherein the tooth 180 engages the gear 164 to prevent the gear 164 and the drive gear 166 from rotating. However, by pivoting the latch member 178 against the force of the spring 188 the tooth 180 can be disengaged from the gear 164 to permit the drive gear 166 to be rotated. The tab 182 is positioned on the latch member 178 so that it is located adjacent the end face of the hub 84 and so that it is therefore engageable by the tab 91 when the hub 84 is in a predetermined rotational position. As a result, when the hub 84 is rotated to a predetermined orientation, the tab 91 engages the tab 182 to pivot the latch member 178 so that the tooth 180 is disengaged from the gear 164.

The animating mechanism 14 further comprises a control disk 190 having a right arm mounting shaft 192 thereon. The control disk 190 is rotatably mounted on the shaft 54 adjacent the gear 136 and it includes a cam segment 194 of increased diameter which extends around approximately one-half of the circumference of the control disk 190. The control disk 190 further includes a lip segment 196 which projects outwardly from the cam segment 194, although the lip segment 196 only extends around approximately one-sixth of the circumference of the control disk 190. The control disk 190 is positioned so that when the right arm 28 of the doll 10 is received on the shaft 192 with the right arm 28 in a forwardly extending position, the lug 184 on the latch member 178 is received inside of the lip segment 196 to prevent the latch member 178 from being pivoted to a position wherein the tooth 180 is disengaged from the gear 164. However, the control disk 190 is constructed so that when the right arm 28 is moved to an upwardly extending position the lip segment 196 is disengaged from the lug 184 to permit the latch member 178 to be pivoted to a position wherein the tooth 180 is disengaged from the gear 164. The control disk 190 is further constructed so that when the arm 28 is in a forwardly extending position the cam segment 194 extends along the inner side of the front housing section 44 for reasons which will hereinafter be set forth.

Also provided in the animating mechanism 14 are a slide member 198 and a linkage member 199. Slide member 198 includes a pointed end 200 and a notched end 202 having a step 204 thereon, and it further includes a rearwardly extending lug 206. The linkage member 199 includes upper and lower sections 208 and 210, respectively, which are connected in longitudinally spaced substantially parallel relation through a stepped section 212. A leg 214 extends outwardly from one side of the step section 212, and a spring 216 is connected to the opposite side thereof. The linkage member 199 further includes a lower terminal section 218 terminating in a tooth 220. An elongated slot 222 is formed in the upper section 208 and an upper terminal section extends upwardly in offset relation from the upper section 208 terminating in a rearwardly extending lug 206. The linkage member 199 and the slide member 198 are received along the inner side of the front housing section 44 so that the lug 206 is received in the slot 222, and so that the linkage member 199 is longitudinally slidable along the inner side of the front housing section 44. The linkage member 199 is retained in the front housing section 44 by an integrally molded retaining loop 228, which allows the linkage member 199 to be longitudinally repositioned, and which further allows the upper portion 208 and the upper terminal portion 224 to be shifted laterally slightly within the housing 42. The slide member 198 is received in the front housing section 44 so that it is positioned between the linkage member 199 and the front housing section 44. The slide member 198 is further positioned in the front housing section 44 so that the pointed end 200 is adjacent the control disk 190. Specifically, the slide member 198 is positioned so that the pointed end 200 is engageable by the cam segment 194 for urging the slide member 198 toward a laterally displaced position in the housing section 44. The slide member 198 is constructed so that when it is moved laterally in the housing section 44, the lug 206 causes the upper portion 208 and the upper terminal portion 224 of the linkage member 199 to also be moved laterally and the spring 216 biases both the linkage member 199 and the slide member 198 in a reverse direction so t hat the linkage member 199 and the slide member 198 are returned to their initial positions when the control disk 190 is disengaged from the slide member 198. When the slide member 198 is moved laterally by the control disk 190 the step 204 on the notched end 202 causes the gear plate 60 to be pivoted slightly so that the gear 64 is disengaged from the ring gear 68. This prevents the left arm 26 from rotating in a clockwise direction during operation of the animating mechanism 14 toward an unwound position. Further, when the linkage member 199 is moved laterally by the slide member 198, the tab 226 is moved into a position of alignment with the tab 150 on the linkage member 144 so that the linkage member 144 can be utilized for longitudinally repositioning the linkage member 199 to an upward position in the housing 42. When this occurs, the arm 214 on the linkage member 199 is moved over a bump 230 on the inner side of the housing section 44 to retain the linkage member 199 in an upwardly shifted position. Accordingly, when the mouth section 24 of the doll's head 22 is manually depressed inwardly causing the pivot member 154 to be pivoted about the axis 156 so that the linkage member 144 is moved upwardly in the housing 42 the tab 150 engages the tab 226 to also shift the linkage member 199 upwardly to a position wherein the arm 214 has passed over the bump 230. The tooth 220 on the lower end of the linkage member 199 is positioned so that when the linkage member 199 is in its unshifted or downward position the tooth 220 engages the enlarged gear 108 of the governor assembly 92 to prevent the governor assembly 92 from being rotated in an unwinding direction, and to thereby prevent the spring 58 from being unwound from the drum 66. However, by moving the right arm 28 to a forwardly extending position so that the control disk 190 cams the slide member 198 laterally to shift the tab 226 on the linkage member 199 to a position of alignment within the tab 150 on the linkage member 144, and then depressing the mouth section 24 inwardly so that the linkage member 144 shifts the linkage member 199 upwardly, the tooth 220 is disengaged from the gear 108 enabling the animating mechanism 14 to be actuated.

When the right arm 28 is in a forwardly extending position and the mouth segment 24 is depressed inwardly to actuate the animating mechanism 14, the spring 58 is gradually unwound from the drum 66. However, because the lug 184 on the latch member 178 is received inside of the lip segment 196 when the arm 28 is in a forwardly extending position, the tooth 180 is retained in engagement with the gear 164 to prevent rotation of the drive gear 166. As a result, when the drum 66 is rotated by the spring 58, the hub 84 is rotated and the exterior gear 80 is held in a stationary position so that the rack gear assembly 48 is retained in a stationary position on the rear side of the rear housing section 46. However, as the hub 84 is rotated in this manner the gear segment 88 engages the gear 136 to operate the mouth animating assembly 126. As this occurs, the eccentric ring 142 engages the cam leg 146 to reciprocate the linkage member 144 up and down and to thereby animate the mouth section 24. When the hub 84 has been rotated to a position wherein the smooth segment 90 is aligned with the gear 136, the mouth animating mechanism is automatically de-actuated, and the tab 91 on the hub 84 engages the tab 182 on the latch member 178. When the right arm 28 is then shifted to an upwardly extending position so that the lug 184 is disengaged from the lip segment 196, the tab 91 on the hub 84 moves the tab 182 to pivot the latch member 178 so that the tooth 180 is disengaged from the gear 164. The tab 182 then prevents the hub 84 from rotating further, but since the tooth 180 is disengaged from the gear 164, the external gear 80 drives the gear 164 to rotate the main drive gear 166. When this occurs, the rack gear 176 travels along the surface of the drive gear 166 to shift the rack gear assembly 48 downwardly and to thereby expand or elongate the torso portion 16.

Still further included in the animating mechanism 14 is a second latch member 232. The second latch member 232 is preferably integrally molded from suitable resilient plastic material and it includes a resilient spring arm 234, and a pivot member 236 having a tooth 238 formed at one end thereof and a de-actuating member 240 formed at the opposite end thereof. The second latch member assembly 232 further includes a pair of shafts 241 which extend outwardly from opposite sides thereof. The second latch member 23 is received and assembled in the rear housing section 46 so that the de-actuating member 240 extends through an opening 242 therein and so that the shaft members 241 are received and secured with a pair of partitions 244 and 246 in the rear housing section 46. The second latch member 232 is normally biased to a position wherein the tooth 238 engages the gear segment 88 on the hub 84 to prevent rotation of the hub 84. However, the de-actuating member 240 is engageable by the rack gear assembly 48 to pivot the latch member 236 to a position wherein the tooth 238 is disengaged from the gear segment 88. More specifically, the rack gear assembly 48 has a notch 248 formed at the upper end thereof and it is formed so that the de-actuating member 240 is received in the engagement in the notch 248 so that the latch member 236 is pivoted to a de-actuated position when the rack gear assembly 48 is in a fully retracted position wherein it is substantially entirely received on the rear side of the rear housing section 46. Consequently, the mouth animating assembly 126, which is driven by the hub 84, can only be operated when the rack gear assembly 48 is in a fully retracted position. In addition, during rewinding of the animating mechanism 14 the hub 84 is held in a stationary position until the rack gear assembly 48 has been fully retracted, and thereafter the hub 84 is rotatable to a fully wound position. In this regard, when the hub 84 is in a fully wound position the gear segment 88 is aligned with the gear 136 in a position wherein a substantial portion of the gear segment 88 intermeshes with the gear 136 before the smooth segment 90 is moved into alignment with the gear 136. Accordingly, during use and operation of the doll 10 the right arm 28 is first positioned in a downwardly extending disposition and the left arm 26 is rotated in a counter clockwise direction to wind the spring 58 onto the drum 66. As the drum 66 is rotated the tooth 220 on the linkage member 199 engages the gear los to prevent rotation of the governor assembly 92 in an unwinding direction and to thereby also prevent rotation of the drum 66 in an unwinding direction. Further, as the drum 66 is rotated the tooth 238 engages the gear segment 88 so that the hub 84 remains stationary, whereas the exterior gear 80 is rotated to rotate the gear 164 and the drive gear 166. As a result, during the initial portion of an unwinding operation the drive gear 166 is operated for returning the rack gear assembly 48 to a retracted position. When the rack gear assembly 48 reaches a fully retracted position it engages the de-actuating member 240 in the notch 248 to pivot the second latch member 232 to a release position. This causes the tooth 238 to be disengaged from the gear segment 88 and the gear segment 88 to be returned to a rewound position as the left arm is rotated further and when the tab 91 engages the upper side of the tab 182 the rewinding operation is complete. By thereafter positioning the right arm in a forwardly extending position so that the slide member 198 is cammed to a laterally shifted position by the cam segment 194, the pinion gear 64 is disengaged from the ring gear 68 and the tab 226 is moved into a position of alignment with the tab 150. By thereafter depressing the mouth section 24 of the head portion 22, the linkage member 144 is shifted upwardly and causing the linkage member 199 to be longitudinally shifted upwardly until the arm 214 passes over the bump 230. This causes the tooth 220 to be disengaged from the gear 108, allowing the governor assembly 92 to be advanced toward a rewound position. However, because the tooth 180 is in engagement with the gear 164, the hub 84 is rotated to drive the mouth animating mechanism 126, whereas the external gear 80 is prevented from rotating by the gear 164 and the tooth 180. As the hub 84 is rotated, the eccentric ring 142 is rotated to reciprocate the linkage member 144, causing the mouth section 24 to be moved inwardly and outwardly by the pivot member 154. Once the hub 84 has been rotated to a position wherein the smooth segment 90 is aligned with the gear 136, the mouth animating mechanism 126 is de-actuated and the tab 91 engages the underside of the tab 182 on the latch member 178. However, because the lug 184 is retained by the lip segment 196, the latch member 178 is prevented from pivoting to a position of disengagement from the gear 164. By then manually pivoting the right arm 28 to an upwardly extending position the lug 184 is disengaged from the lip segment 196, although the slide member 198 is retained in a shifted position. The tab 91 then engages the tab 182 to pivot the latch member 178 so that the tooth 180 is disengaged from the gear 164 and so that the hub 84 is prevented from rotating by the tab 182. Once the latch 178 is disengaged from the gear 164, the gear 164 is rotated by the gear 80 to rotate the main drive gear 166, and the rack assembly 48 is advanced toward the downwardly extended position illustrated in FIG. 8. As the rack gear assembly 48 is advanced toward the extended position thereof the notch 248 is disengaged from the de-actuating member 240 causing the tooth 238 to be received in engagement in the gear segment 88 so that the hub 84 is further prevented from rotating. As a result the mouth section 24 remains stationary as the upper torso section 18 is advanced upwardly relative to the lower torso section 20 to simulate a growing action.

It is seen therefore that the instant invention provides an effective doll construction which is adapted for performing amusing and interesting activities. Specifically, the doll 10 is adapted for performing a simulated chewing activity and for thereafter performing a simulated growing activity. As a result, the doll 10 has a high level of play value and it is seen to represent a significant advancement in the toy art having substantial commercial merit.

What is claimed:

1. A toy doll construction comprising a doll body including a torso portion and a head portion, said torso portion being longitudinally expandable and contractible for increasing and decreasing the height of said doll body, respectively, said head portion including a mouth section and being adapted to permit movement of said mouth section simulating a chewing action, and animating means in said doll body actuatable for moving said mouth section to simulate a chewing action and for thereafter longitudinally expanding said torso portion from a contracted position to an expanded position.

2. In the toy doll construction of claim 1, said animating means being operative by manually placing said animating means in a set position and thereafter manually depressing said mouth section to actuate said animating means for moving said mouth section to simulate a chewing action.

3. In the toy doll construction of claim 2, said animating means being manually actuatable for longitudinally expanding said torso portion after said animating means has been actuated for moving said mouth section.

4. In the toy doll construction of claim 1, said doll body further comprising a pair of arms, said animating means being manually windable by rotating a first one of said arms.

5. In the toy doll construction of claim 4, said animating means being operative by manually placing said animating means in a set position by moving the second one of said arms to a predetermined position and then manually depressing said mouth section to actuate said animating means to simulate a chewing action.

6. In the toy doll construction of claim 1, said torso portion including slidably interfitting upper and lower torso sections, said upper and lower torso being movable relative one another in telescoping relation for expanding and contracting said torso portion.

7. In the toy doll construction of claim 1, said animating means including a rack and pinion gear assembly for expanding and contracting said torso portion.

8. In the toy doll construction of claim 1, said head portion including a resiliently flexible mouth section, said animating means including means for alternately moving said flexible mouth section inwardly and outwardly to simulate a chewing action.

9. In the toy doll construction of claim 1, said animating means comprising a gear assembly in said torso portion and linkage means extending from said gear assembly into said head portion and attached to said mouth section, said gear assembly being actuatable for reciprocating said linkage means to move said mouth section to simulate a chewing action.

10. In the toy doll construction of claim 9, said animating means being actuatable by manually said mouth section to longitudinally said linkage means and to thereby actuate said gear means for reciprocating said linkage means to move said mouth section.

11. A toy doll construction comprising a doll body including a torso portion and a head portion, said head portion including a mouth section and being adapted to permit movement of said mouth section simulating a chewing action and animating means in said doll body for moving said mouth section to simulate a chewing action, said animating means being operative by manually moving said animating means to a set position and then manually depressing said mouth section to actuate said animating means to simulate a chewing action.

* * * * *